US009566820B2

(12) United States Patent
Flaig

(10) Patent No.: US 9,566,820 B2
(45) Date of Patent: Feb. 14, 2017

(54) DEVICE FOR DOSED DISPENSING OF FLUID MEDIA

(71) Applicant: Gebr. Schmidt Fabrik fuer Feinmechanik GmbH & Co. KG, St. Georgen (DE)

(72) Inventor: Helmut Flaig, Eschbronn (DE)

(73) Assignee: Gebr. Schmidt Fabrik fuer Feinmechanik GmbH & Co. KG, St. Georgen (DE)

( * ) Notice: Subject to any disclaimer, the term of this patent is extended or adjusted under 35 U.S.C. 154(b) by 659 days.

(21) Appl. No.: 13/753,583

(22) Filed: Jan. 30, 2013

(65) Prior Publication Data

US 2013/0144213 A1 Jun. 6, 2013

Related U.S. Application Data

(63) Continuation of application No. PCT/EP2011/062824, filed on Jul. 26, 2011.

(30) Foreign Application Priority Data

Aug. 3, 2010 (DE) ..... 10 2010 033 576

(51) Int. Cl.

| | |
|---|---|
| ***B43K 5/00*** | (2006.01) |
| ***B43L 19/00*** | (2006.01) |
| ***B43K 5/18*** | (2006.01) |
| ***B43K 8/02*** | (2006.01) |
| ***B43K 8/04*** | (2006.01) |
| ***B43M 11/06*** | (2006.01) |
| ***B65D 47/20*** | (2006.01) |

(Continued)

(52) U.S. Cl.

CPC ..... *B43L 19/0018* (2013.01); *B43K 5/1818* (2013.01); *B43K 5/1836* (2013.01); *B43K 8/022* (2013.01); *B43K 8/04* (2013.01); *B43M 11/06* (2013.01); *B65D 47/2018* (2013.01); *B65D 47/42* (2013.01); *A45D 40/262* (2013.01)

(58) Field of Classification Search

CPC ..... A61M 3/00; A61M 5/00; B43K 5/1818; B43K 5/1836; B43K 8/022; B65D 47/42; B65D 47/2018; B43L 19/0018; B43M 11/06

USPC ..... 604/256

See application file for complete search history.

(56) References Cited

U.S. PATENT DOCUMENTS

| | | | |
|---|---|---|---|
| 1,687,647 | A | 12/1926 | Garvey |
| 3,902,815 | A | 9/1975 | Williams |

(Continued)

FOREIGN PATENT DOCUMENTS

| | | |
|---|---|---|
| DE | 199 34 445 A1 | 2/2001 |
| EP | 0 256 279 | 2/1988 |

(Continued)

*Primary Examiner* — Edelmira Bosques

(74) *Attorney, Agent, or Firm* — Harness, Dickey & Pierce, P.L.C.

(57) ABSTRACT

A device for dosed dispensing of a fluid medium is provided with a pen-like housing which has a storage chamber for accommodating the fluid medium and which has at its front end a tip in which there is provided an outlet opening for the fluid medium. Arranged in the front end is a valve element which closes the outlet opening under the force of a spring and is arranged such that it at least partially opens the outlet opening in the event of radial pressure being applied from the outside on the front end of the housing. The valve element is arranged in a tiltable manner at the outlet opening.

16 Claims, 12 Drawing Sheets

(51) Int. Cl.

| | |
|---|---|
| ***B65D 47/42*** | (2006.01) |
| *A45D 40/26* | (2006.01) |

(56) References Cited

U.S. PATENT DOCUMENTS

| | | | |
|---|---|---|---|
| 4,848,947 | A | 7/1989 | Kremer et al. |
| 2007/0201940 | A1 | 8/2007 | Ziniti et al. |

FOREIGN PATENT DOCUMENTS

| | | | |
|---|---|---|---|
| EP | 0 316 007 | A2 | 5/1989 |
| FR | 1434743 | | 4/1966 |
| WO | WO 02/16146 | A1 | 2/2002 |

DEVICE FOR DOSED DISPENSING OF FLUID MEDIA

CROSS-REFERENCE TO RELATED APPLICATIONS

This is a continuation application of co-pending international patent application PCT/EP 2011/062824, filed Jul. 26, 2011 and designating the United States, which was published in English as WO 2012/016884 A1, and claims priority to German patent application DE 10 2010 033 576, filed Aug. 3, 2010. These priority applications are incorporated herein by reference.

BACKGROUND OF THE INVENTION

The present invention relates to a device for dosed dispensing of a fluid medium, said device comprising a pen-like housing which has a storage chamber for accommodating the fluid medium and which has at its front end a tip in which there is provided an outlet opening for the fluid medium, and further comprising a valve element which is arranged in the front end, closes the outlet opening under the force of a spring and is arranged such that it at least partially opens the outlet opening in the event of radial pressure being applied from the outside on the front end of the housing.

Such a device is known from EP 0 256 279 A1.

The known device is what is known as a metering pen with which fluid media can be dispensed in a dosed manner.

A "fluid medium" is understood within the context of the present invention to mean flowable liquids, materials and substances of any kind, which are held in a storage chamber in a metering pen and are dispensed in a dosed manner as desired. These include, for example, refinish paints and liquid or pasty correction agents which are applied to the surfaces to be treated via an applicator, for example a brush or wick, provided in the tip of the metering pen.

Such metering pens are for example used to eliminate paint damage on motor vehicles or to repair scratches and scores on structural elements such as window frames, etc., before they are painted over.

On account of the possibly relatively long storage time of the metering pens filled with the fluid media, it is frequently necessary to remix the medium, for which purpose there is provided in the metering pen a mixing ball which ensures that the medium is mixed again when the metering pen is subjected to a shaking movement.

What is also important is the option of being able to dispense the fluid media in a dosed manner, since it is frequently the case that only small amounts of the medium are required for the work to be carried out and the applicator should not become oversaturated with the medium.

In order to make this possible, the device known from above-mentioned EP 0 256 279 A1 has a cylindrical housing in which a storage chamber for the respective liquid medium to be used is provided. At its tip, the housing has an opening which is closed by an axially movable valve element in the form of a sealing rod. At the upper end of the sealing rod there is arranged a membrane plate which is pushed forwards by a compression spring so that the sealing rod closes the outlet opening by way of its front end.

In the region of the tip, the housing is produced from an elastically deformable shell so it can be pushed in there. Pushing in the housing shell on radially opposite sides or from one side only causes the membrane plate to be bent upwards, as a result of which it moves the sealing rod likewise upwards and thus lifts the sealing element fitted at the front end of the sealing rod off the outlet opening, thereby opening an annular gap through which medium can emerge.

Disadvantages with this device are in particular the large number of parts required and also the welded connection required between the tip, which consists of the elastically deformable and therefore thin housing shell, and the rest of the housing.

It is also disadvantageous that the mixing of the medium with the aid of the mixing ball is not always ensured, because the medium that accumulates in the region of the front tip cannot move readily into the rear region, since the membrane plate causes virtually complete sealing off of the chamber in the front tip from the rear storage chamber.

A comparable device is known from U.S. Pat. No. 3,902,815 A. In this device, the outlet opening for the liquid at the tip of the housing is closed by a stem-like valve member which is pushed axially forwards by a compression spring into the closed position. In order to open the outlet opening, there are provided push buttons, which are arranged diametrically in the housing wall and when pushed together ensure via interposed leaf springs that the valve member moves axially towards the rear and opens the outlet opening.

FR 1 434 743 A1, too, describes a comparable device, in which the outlet opening is closed via an axially adjustable valve member.

The two last-discussed devices are also structurally complex and so have problems associated with assembly and with use.

US 2007/0201940 A1 discloses a liquid applicator having an applicator that is displaceable in longitudinal direction and interacts with a front end of a valve element.

DE 199 34 445 A1 discloses a device for dispensing a fluid like ink from a fluid chamber through an inner channel provided in a valve part. The valve part has a tip protruding from the fluid chamber through a further channel provided in an inwardly pointing cylindrical shank provided at a front face of the fluid chamber.

The rear end of the valve part is a cylindrical block having the same outer diameter as the shank. The inner channel terminates in lateral openings provided between the shank and the cylindrical block. By this, fluid from the fluid chamber can pass through the lateral openings into the inner channel and therefrom to the outside.

However, provided on the shank and the cylindrical block is a helical spring which separates the fluid chamber from an inner chamber surrounding the lateral openings. The coils of the helical spring are tightly compressed such that no fluid can pass from the fluid chamber into the inner chamber, so that the valve is closed.

The tip is arranged within the channel such that it can be tilted. When the tip is tilted this bulges the helical spring such that the coils are splayed apart to open a fluid passage from the fluid chamber to the inner chamber.

Thus, when the tip is at rest, the coil closes off the fluid chamber. When the tip is tilted, the coil opens fluid passages that allow flow of ink from the fluid chamber through the lateral openings and the inner channel to the outside.

In this construction, the valve element, in the meaning of the present invention, is the helical spring, although it cannot be opened by applying radial pressure to the fluid chamber.

This construction has several disadvantages. When the tip is at rest, the inner chamber is still connected via the lateral openings to the inner channel, so that over the time all fluid trapped within the inner chamber can either drop out or get dried. This, of course, cannot be accepted.

Further, as the helical spring has tightly compressed coils in order to ensure closure of the fluid chamber, a large tilting force is required to open the fluid passages between certain coils.

Still further, a sealing ring is provided in the further channel provided in the inner shank. This sealing ring surrounds the tip of the valve part and allows the tilting thereof. The further channel is in fluid communication with the fluid chamber as soon as the tip is tilted. However, tilting the tip stresses the sealing ring so that fluid may pass the sealing ring and rinse out of the fluid chamber on the outer surface of the tip. This can by no means be accepted.

Seen as a whole, this known device is unsuited for dosed application of a fluid medium in the meaning of the present application.

SUMMARY OF THE INVENTION

In view of the above, it is among others one object of the present invention to improve the device mentioned at the outset in such a way that it has a simple structure and is easy to assemble and reliable to use.

In the case of the device mentioned at the outset, this and other objects are achieved in that the valve element is arranged in a tiltable manner at the outlet opening.

The inventor has thus departed from the path specified in the prior art of closing and opening the outlet opening via an axially movable sealing element, but rather has created a tiltable valve element, the guidance of which in the housing is subject to fewer demands than an axially adjustable element.

On account of the fewer demands made of the guidance, the novel device can be constructed with a smaller number of individual parts, and is also very failsafe in its operation and function, since all that is required to open the outlet opening is to tilt the valve element to the side. This results in the formation of an opening through which the medium can pass to the outlet opening.

The inventor has found that the tilting of the valve element also opens the outlet opening much more than in the case of a prior art sealing element which is merely lifted off axially.

According to one object, the valve element has at its front end a sealing element for closing the outlet opening and is designed at its rear end to accommodate the front end of an axially acting compression spring.

This measure is structurally advantageous since a single valve element ensures at its front end that the outlet opening is closed and is provided at its rear end with an axially acting compression spring which in the first instance exerts a closing pressure on the valve element.

The valve element can be designed in this case at its rear end as a stem or pin, onto which the front end of the compression spring is pushed. The pin can in this case be in the form of a star in cross section so that medium can flow forwards past the outside of the pin to the outlet opening.

However, an axially acting compression spring also makes it possible to push the valve element radially outwards at its rear end in order in this way to open the outlet opening. As soon as the opening pressure is relieved, the compression spring moves the valve element back in the axial direction and thus closes the outlet opening. In this case, it is not necessary to fix down the valve element at the outlet opening for example by way of a joint or similar structural element; it can rest in a freely tiltable manner at the outlet opening or the edge thereof and be held in this position by the compression spring.

In order to allow the dosing function, according to one object of the invention just one valve element and one compression spring are required.

The valve element can according to one object be a one-piece plastics part, wherein the compression spring may be produced from metal or likewise from plastic. The compression spring may also be formed in one piece with the valve element, for which purpose the valve element and the compression spring are produced for example from plastic.

According to another object, the housing has at its front end a preferably flattened gripping region which is made of material that can be elastically deformed under pressure and which is located approximately at the same axial level as the rear end of the valve element.

This measure increases in particular the operability of the novel device, since the gripping region indicates where pressure needs to be applied to the wall of the housing in order to tilt the valve element.

If the gripping region is additionally flattened, only a small force is required in the region of this flattening to push in the wall and to tilt the valve element. The circumferentially remaining region of the housing at the axial level of the gripping region is formed in a circular manner and thus is pressure-resistant despite a possibly thin wall of the elastic material.

This is a particular advantage over the device from the generic EP 0 256 279 A1, where the gripping region is provided circumferentially with a thin wall.

Furthermore, it is one object that the rear end of the compression spring extends as far as approximately above the gripping region and is anchored there inside the housing.

This measure ensures in an advantageous manner the tiltability of the valve element, since the compression spring, which can be in the form of a helical compression spring, extends over a certain length of the housing and so the force required to tilt the valve element is low, but the spring, on account of its compression force acting in the axial direction, nevertheless ensures reliable sealing of the outlet opening when the radial pressure is removed.

According to a still further object, the valve element is designed at its rear end as a cylindrical bushing in which the front end of the compression spring is arranged.

This measure, too, is structurally advantageous, since the front end of the compression spring is seated in an immovable manner in the cylindrical bushing, and so when excessive force is exerted on the gripping region the compression spring does not accidentally come out of the valve element.

It is also structurally advantageous here in particular that the compression spring does not have to be specially fixed in or on the valve element; the front end of the compression spring merely needs to be inserted into the cylindrical bushing.

At least one through-opening for the fluid medium may be provided in or on the valve element.

In the case of this measure, it is advantageous that the region in the tip is fluidically connected to the rear storage chamber and so when the medium is mixed after a long period of storage it is ensured that even the medium present in the front region of the metering pen can be supplied for mixing.

Generally, the outlet opening may be enclosed by an annular shoulder on which the sealing element rests, and the valve element may have preferably at its front end a sealing element, which further preferably is a sealing plate consisting of a flexible material, and/or comprises a peripheral sealing ring.

These measures are advantageous individually and in combination, because they ensure good sealing of the outlet opening. The sealing cone can in this case engage at least partially into the outlet opening, with a sealing plate produced from flexible material ensuring reliable sealing of the outlet opening even in the case of slight material unevenness by resting flat against the annular shoulder. The peripheral seal also contributes to nevertheless ensuring reliable sealing in the case of slight manufacturing inaccuracies.

Overall, these and other measures allow simple and cost-effective manufacturing of the novel device without the sealing reliability being negatively affected by relatively small manufacturing inaccuracies.

A lateral recess may be provided on the inside of the tip at the outlet opening, said lateral recess facing a gripping region via which the valve element can be tilted.

It is advantageous with this measure that the outlet opening and the wall which surrounds it inside the tip are laterally enlarged where the valve element is lifted off the outlet opening in the case of tilting brought about via the gripping region, so that a large opening is opened for the medium and the medium can flow through this opening in a sufficient quantity.

Generally, a channel for accommodating an applicator may be provided in the tip of the housing, wherein the outlet opening opens out into the channel.

It is advantageous here that various applicators can be inserted into the channel, with consideration being given in particular to wicks or brushes which can be inserted without problems into the channel with the aid of a fitting bushing.

This measure, too, contributes to a structurally simple construction of the novel device.

According to another object, a sensing tip may be provided on the valve element, said sensing tip extending through the outlet opening and the channel and protruding forwards beyond the channel.

This measure provides a further actuation option for the valve element. This is because when radial or axial pressure is applied to the sensing tip that protrudes forwards beyond the channel, the valve element is lifted off the outlet opening and so the medium can flow into the channel, where it then saturates the applicator.

With this measure, it is thus not necessary to tilt the valve element by applying pressure to the actuating region; rather this can also take place while the metering pen is being used by the corresponding application of pressure to the sensing tip extending in the applicator.

One possible application consists here in that the applicator is initially saturated with medium by the application of lateral, i.e. radial pressure on the valve element at the gripping region, with it then being possible, during the application of the medium to the surface to be treated, for the "subsequent delivery" of fluid to be controlled by the applicator and thus the sensing tip being pressed more or less strongly onto the surface. This allows particularly elegant and simple use of the novel device.

The sensing tip may be formed in one piece with the valve element, so that, in spite of the additional possibility of controlling the flow of medium, the structurally simple construction of the novel device from as few parts as possible is retained.

Alternatively, the applicator may be arranged such that it can be displaced longitudinally in the channel and projects towards the rear through the outlet opening so that it interacts with the front end of the valve element.

This constitutes a further way of actuating the valve element via the applicator. By axial displacement of the applicator into the housing, the valve element is lifted off the outlet opening and so medium can pass to the applicator.

As already mentioned in connection with the sensing tip, in this way the applicator can be saturated with medium initially by the application of radial pressure to the gripping region, it then being possible to control the subsequent flow of the medium in a very simple manner by the pressure of the applicator on the surface to be treated.

According to a further object, the applicator may be held in an insert which is mounted in the channel such that it can be displaced longitudinally to a limited extent and which interacts by way of its upper end side with the front end of the valve element.

It is advantageous here that the stroke of the applicator is limited, so that the valve element can be lifted off the outlet opening only to a predefined degree. As a result, the opening for the subsequent flow of the medium is limited, and so the permissible stroke of the valve element also determines the amount of medium which can pass per unit time to the applicator.

It is thus possible for the applicator not to be pushed fully into the channel, which makes use easier, since the user does not have to pay attention, when applying the medium to the surface to be treated, to how far he pushes the applicator into the channel.

Finally, it should be mentioned that in the context of the present invention "lower end" or "front end" means the region towards the front tip of the metering pen where the applicator protrudes out of the housing and the metering pen is grasped by the user.

Accordingly, "upper end" or "rear end" means the region remote from the lower end of the metering pen, where the closure for the storage chamber is fitted.

Consequently, "from below" means the direction pointing from the lower to the upper end and "from above" means the direction pointing from the upper to the lower end. "Above" and "below" accordingly mean "in the direction towards the rear end" and "in the direction towards the front end", respectively.

"Axial direction" means accordingly the longitudinal direction of the device from its front to its rear end, i.e. the longitudinal center axis in the case of a metering pen.

Further advantages can be gathered from the description of the appended drawings.

It goes without saying that the abovementioned features and those mentioned below can be used not only in the respectively stated combination but also in other combinations or on their own, without departing from the scope of the present invention.

BRIEF DESCRIPTION OF THE DRAWINGS

Embodiments of the invention are illustrated in the drawing and explained in more detail in the following description. In the drawing.

DESCRIPTION OF PREFERRED EMBODIMENTS

Figure 1:
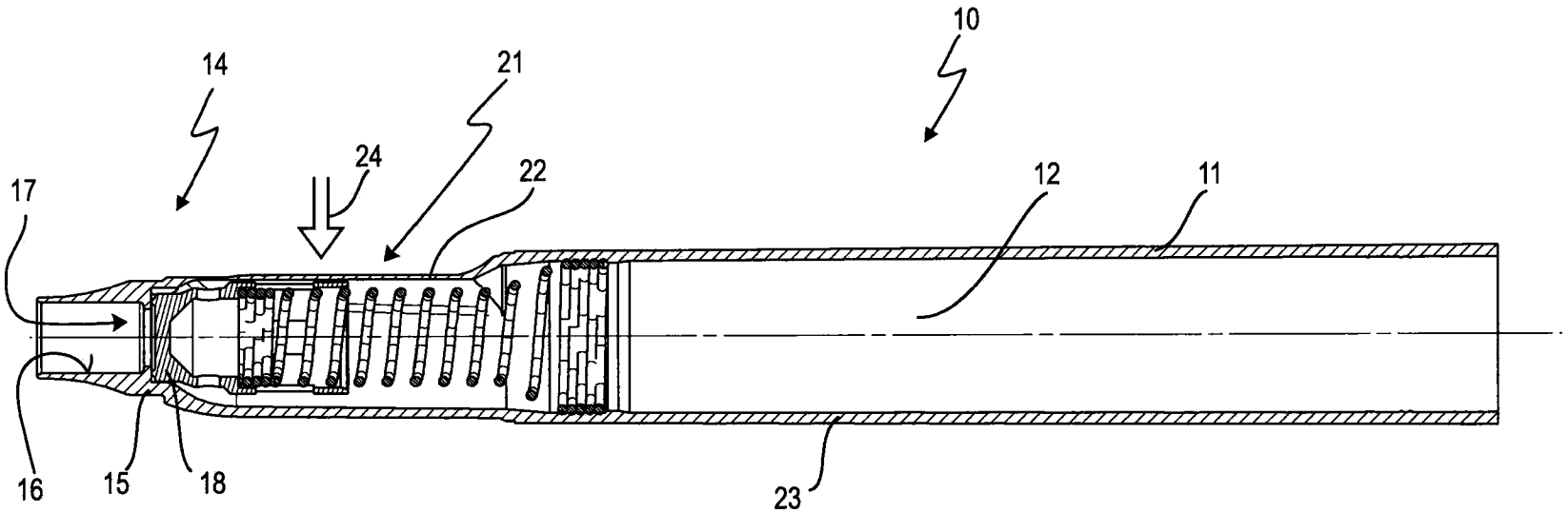
FIG. 1 shows a longitudinal section through the novel device, but without an applicator and closure plug.

FIG. 1 shows a schematic longitudinal section and side view of a device 10 which serves for dosed dispensing of fluid media.

The device 10 comprises a pen-like housing 11 which has a storage chamber 12 for accommodating the fluid media. At its front end 14, the housing 11 is equipped with a tip 15 in which there is arranged a channel 16 which extends axially to an outlet opening 17.

An applicator is to be inserted in a manner yet to be described in the channel 16 in order that the medium can be applied to a surface to be treated.

Figure 9:
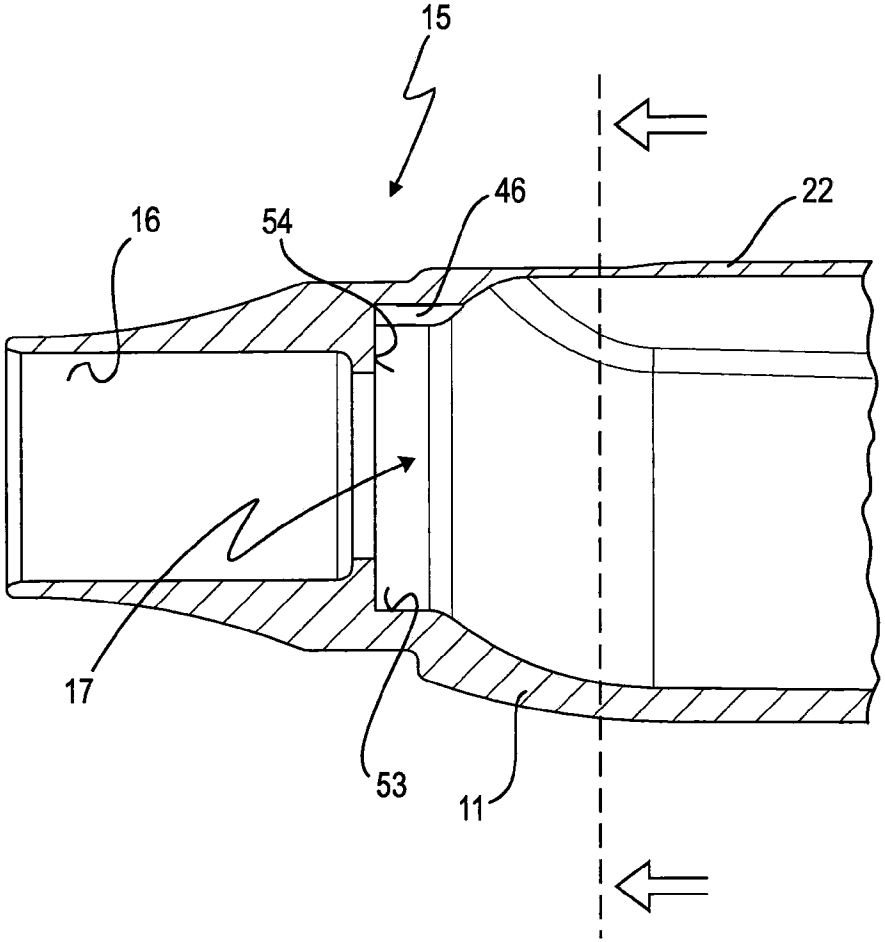
FIG. 9 shows a section through the tip of the housing in the longitudinal direction and a section through the tip of the housing in the radial direction.
Figure 9:
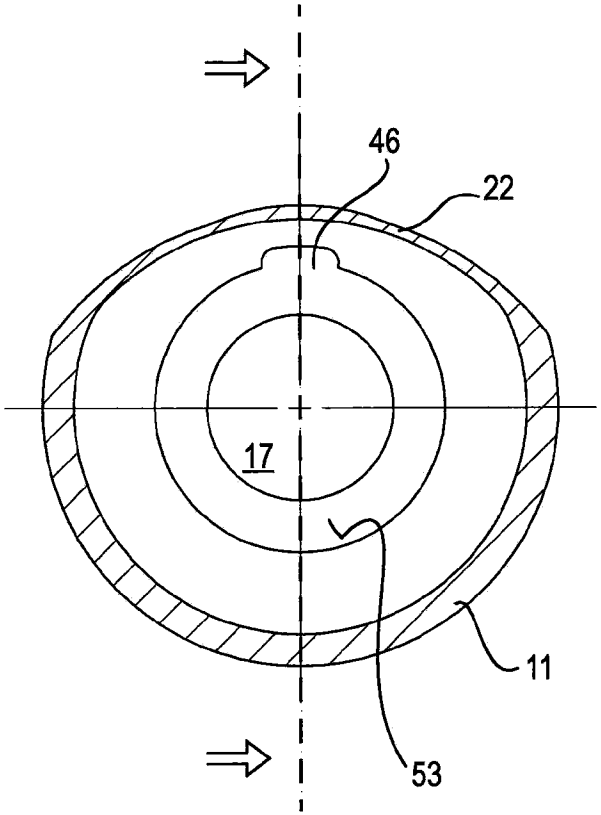

Inside the housing 11, a valve element 18 is fitted on the outlet opening 17, said valve element 18 resting, such that it can tilt freely, on the edge, which can be seen more clearly in FIG. 9, of the outlet opening 17 and being biased under the force of a compression spring 19 in the closed position, which is shown in FIG. 1 and in which it closes the outlet opening 17.

The tip 15 is adjoined axially to the rear, i.e. to the right in FIG. 1, by a flattened gripping region 21, the wall 22 of which has a smaller thickness in this region than the wall 23 of the accommodating chamber 12 in the rear region of the housing 11. The housing 11 with the tip 15, gripping region 21, wall 22 and wall 23 is produced in one piece from plastic.

The material of the gripping region 21 can be elastically deformed under pressure, and so a pressure exerted in the direction of the arrow 24 leads to the valve element 18 tilting, i.e. moving in FIG. 1 in the rear region, i.e. where the compression spring 19 meets the valve element 18, downwardly in FIG. 1, as will be described below.

Figure 2:
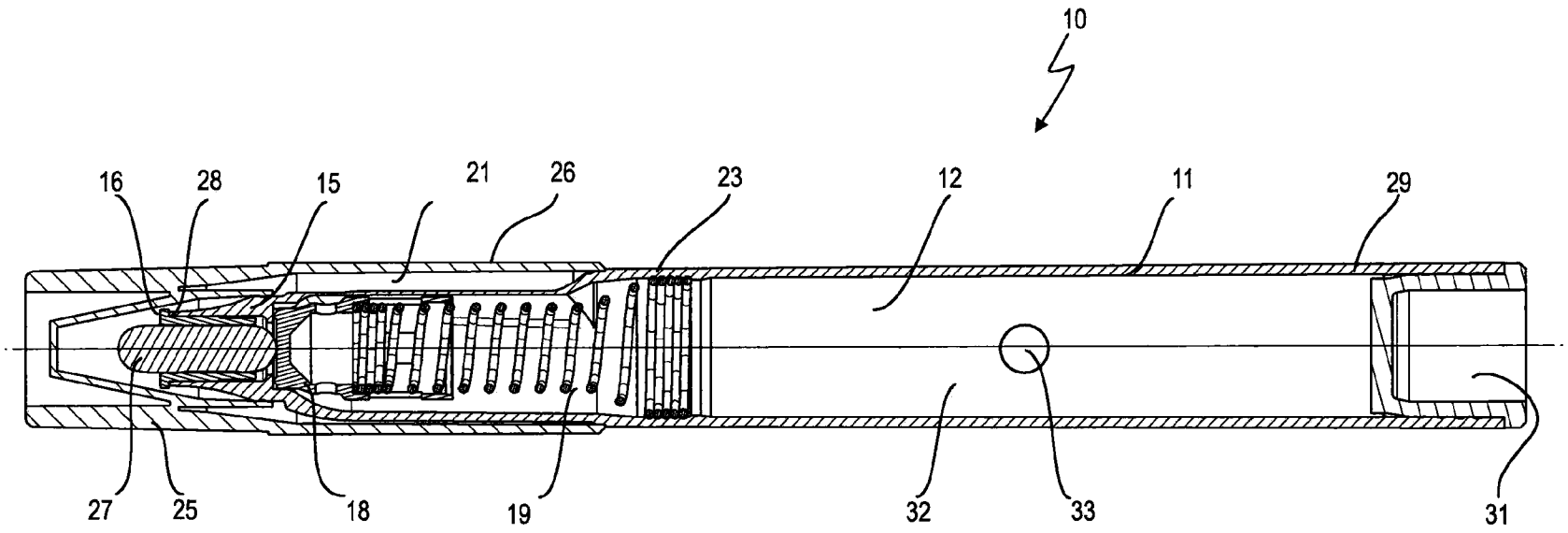
FIG. 2 shows an illustration as in FIG. 1, but with applicator, closure cap, closure plug and introduced medium.

FIG. 2 shows the device 10 from FIG. 1 in the same sectional illustration, with a closure cap 25 now having been positioned on the tip 15, said closure cap 25 extending by way of its wall 26 over the flattened gripping region 21 as far as the wall 23 in order in this way to avoid unintentional actuation of the valve element 18 during transport.

In the tip 15 there is now fitted an applicator 27 in the form of a wick, which is held in the channel 16 via a fitting bushing 28.

The housing 11 is provided at its rear end 29 with a closure plug 31 so that medium 32 introduced into the storage chamber 12 cannot run out.

It can be seen in FIG. 2 that the medium 32 extends over the entire interior of the housing 11, i.e. passes through the compression spring 19 and into the valve element 18. From there, with the valve element 18 tilted, it passes through the outlet opening 17 and into the channel 16 where it saturates the applicator 27.

A mixing ball is indicated at 33 in FIG. 2 and ensures that the medium 32 is mixed when the device 10 is subjected to a shaking movement.

Figure 3:
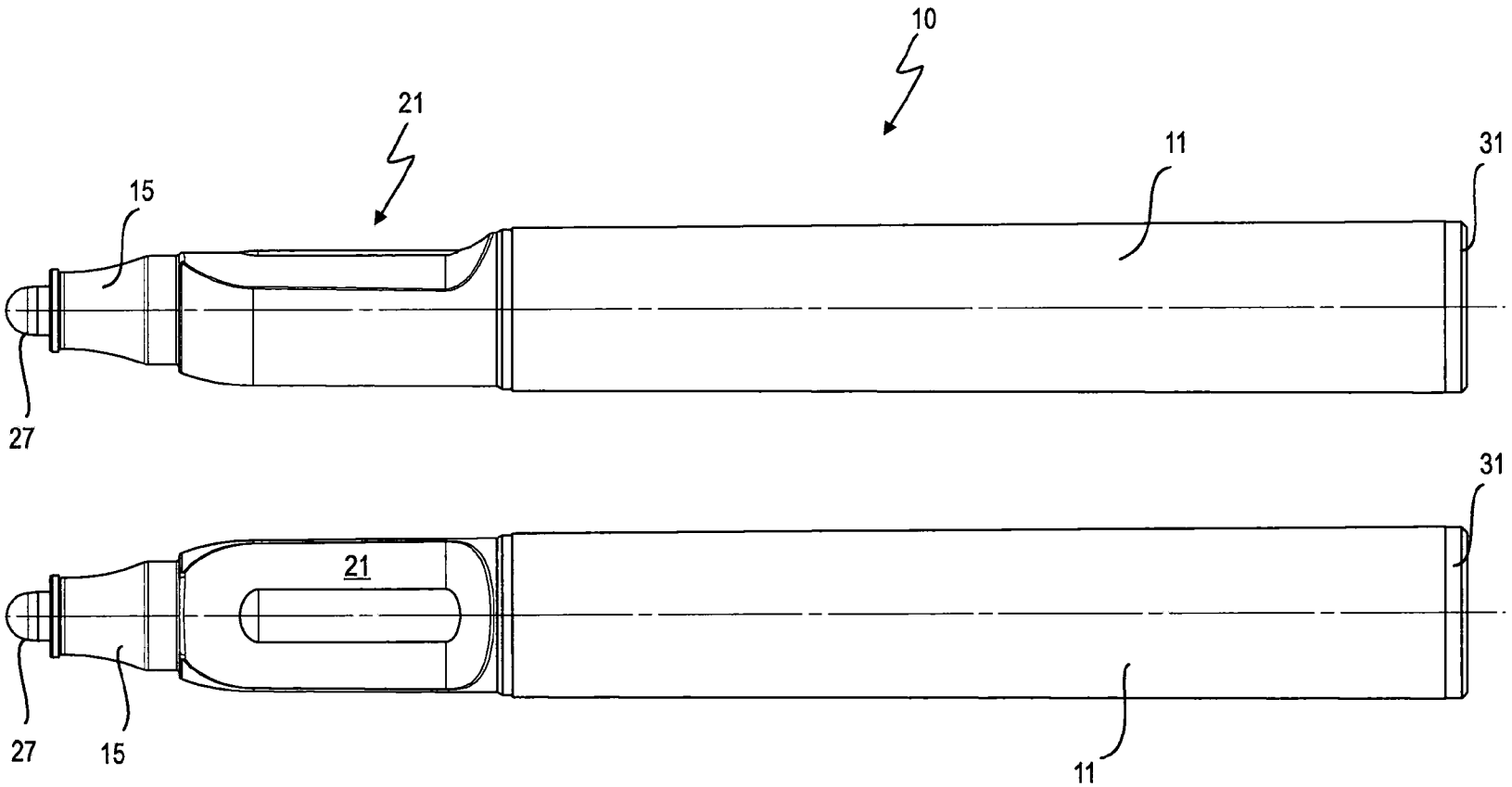
FIG. 3 shows a side view and plan view of the device from FIG. 2, but without the closure cap.

FIG. 3 shows at the top a side view of the device 10 from FIG. 2 and at the bottom FIG. 3 shows a plan view thereof. In this case, in particular the flattened gripping region 21 is clearly visible, said region serving for grasping the device 10, which is designed here as a metering pen. The gripping region 21 allows not only the actuation of the device 10 but also makes this easier, because it indicates where radial pressure has to be exerted from the outside in order to tilt the valve element.

Figure 4:
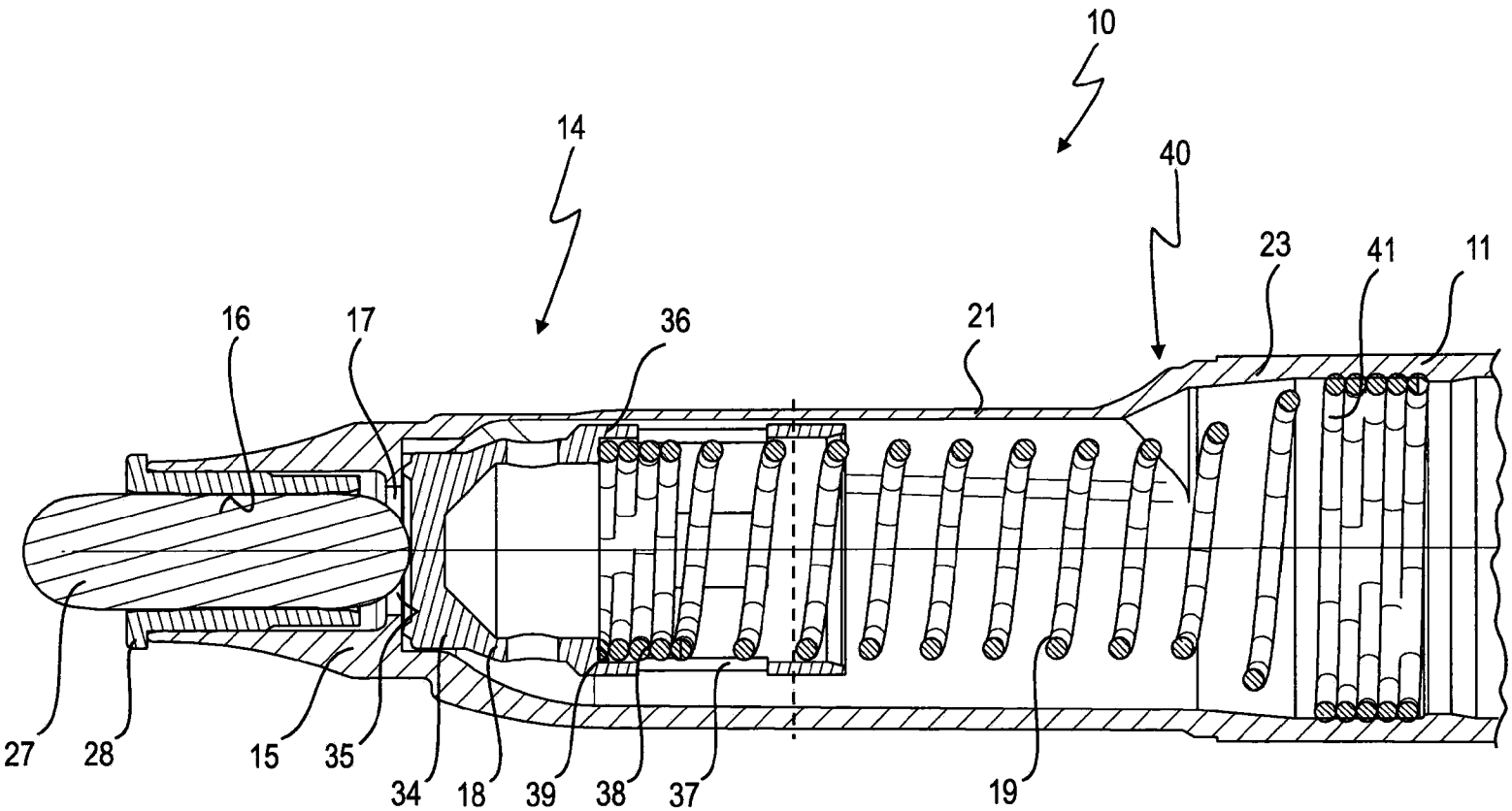
FIG. 4 shows an enlarged sectional illustration in the region of the tip of the device from FIG. 1, with the valve element closed.

FIG. 4 shows the device 10 from FIG. 2, but without a closure cap 25, on a larger scale in the region of the front end 14.

It can be seen from FIG. 4 that the valve element 18 has at its front end 34 a sealing element in the form of a sealing plate 35 which rests on the outlet opening 17 and closes it. The sealing plate 35 consists of a flexible material which adapts to relatively small unevenness around the outlet opening 17 and so ensures reliable sealing.

At its rear end 36, the valve element 18 is provided with a cylindrical bushing 37 in which the front end 38 of the spring 19 is arranged such that it rests on a shoulder 39 provided in the bushing 37.

The spring 19 extends to the rear along the entire gripping region 21 and its rear end 41 is fixed in a suitable manner, for example clamped in or adhesively bonded, inside the housing 11, above the gripping region 21, i.e. above the transition region 40 from the gripping region to the wall 23.

In this way, the compression spring 19 presses the valve element 18 onto the outlet opening 17 and closes the latter via the sealing element 35, which is arranged at the end at the front end 34 of the valve element 18.

Figure 10:
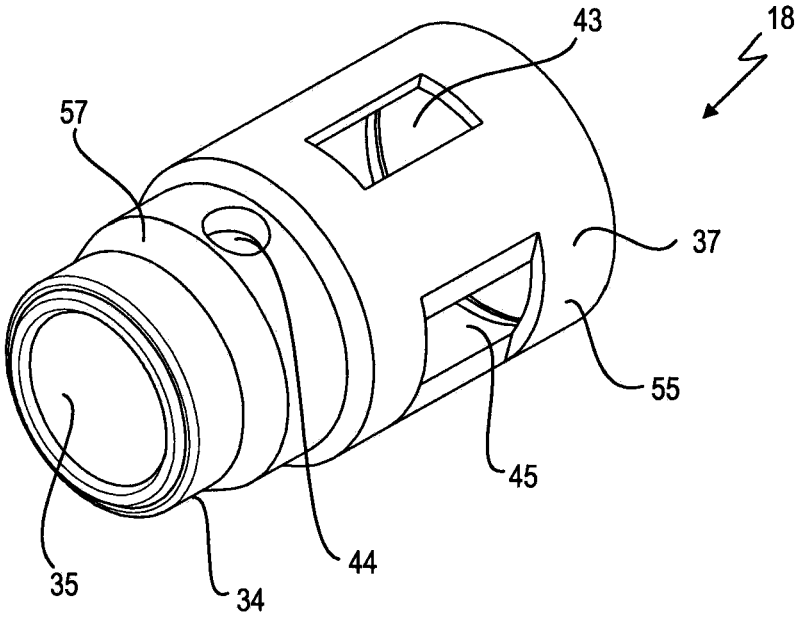
FIG. 10 shows at the bottom an illustration in longitudinal section and at the top a perspective illustration of the valve element according to the embodiment from FIGS. 1 to 9.
Figure 10:
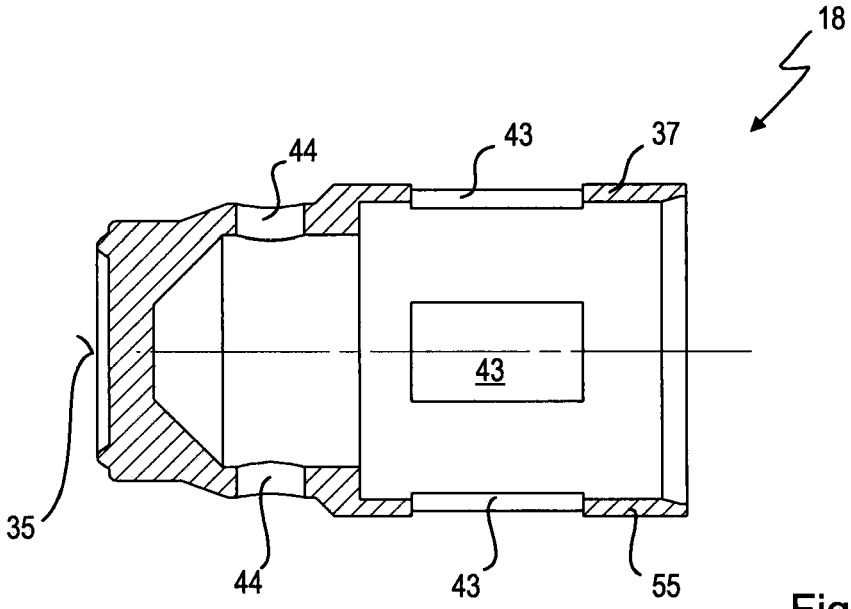
Figure 11:
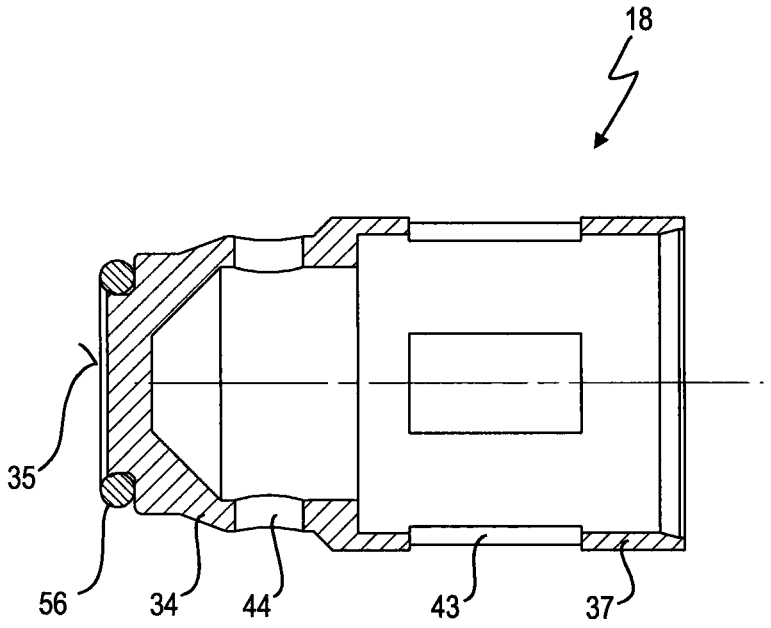
FIG. 11 shows, in a sectional illustration as in FIG. 10, bottom, a further embodiment of the valve element.

The valve element 18 is shown in detail in FIGS. 10 and 11.

Figure 5:
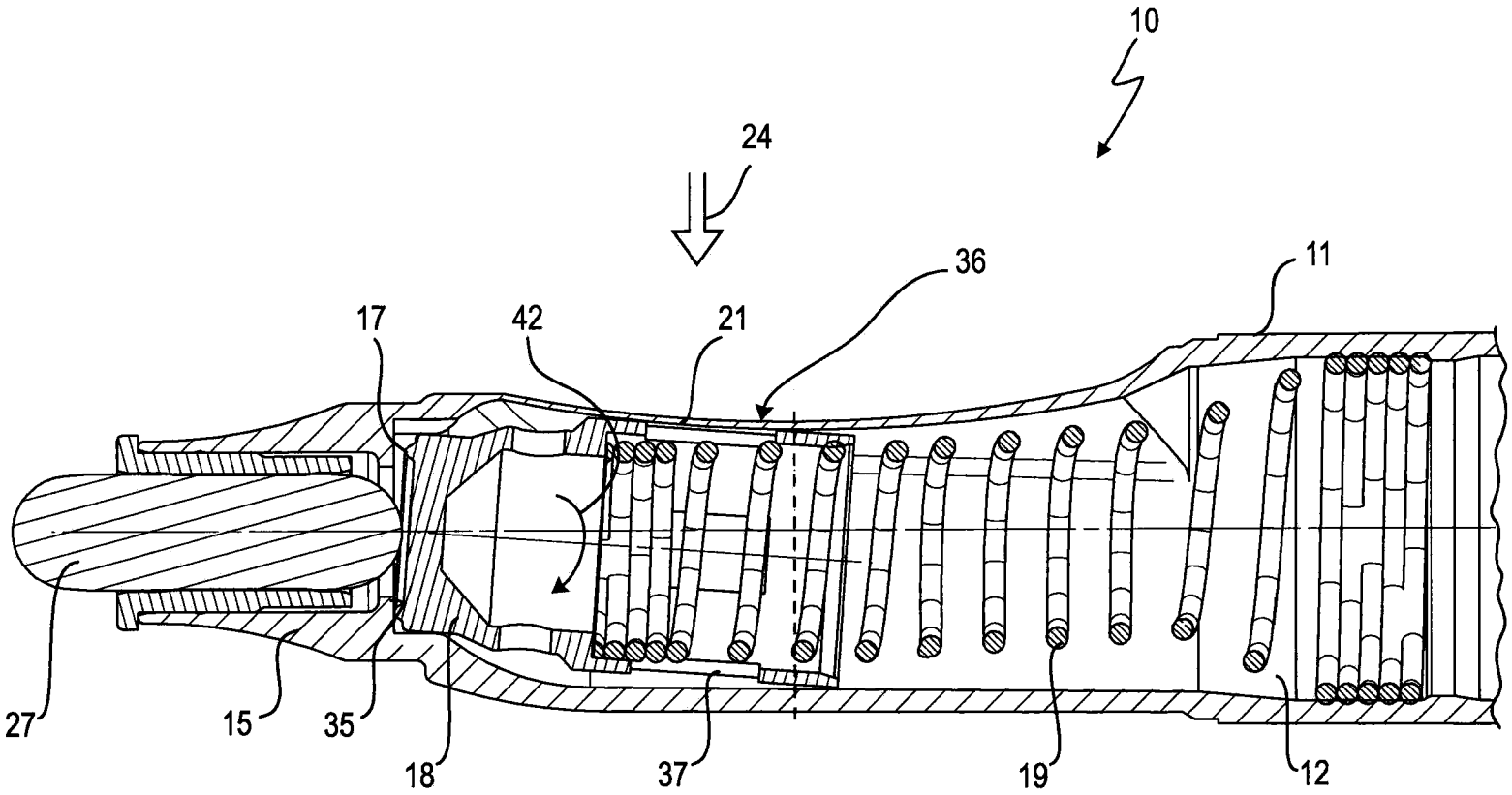
FIG. 5 shows an illustration as in FIG. 4, but with the valve element tilted.

FIG. 5 shows the device 10 from FIG. 4, with radial pressure now being exerted on the gripping region 21 from outside in the direction of the arrow 24 according to FIG. 1.

Since the gripping region 21 is located at the same axial height as the rear end 36 of the valve element 18, i.e. at the same axial height as the bushing 37, this pressure 24 causes the valve element 18 to carry out a tilting movement in the direction of the arrow 42, as a result of which the sealing element 35 at the end is lifted off the outlet opening 17.

This tilting movement 42 of the valve element 18 is made possible by the compression spring 19 having an appropriate axial length so that it so to speak "buckles" in the middle and allows the tilting movement 42. At the same time, the compression spring 19 exerts such an axial force on the valve element 18 that, as the radial pressure 24 is reduced, it aligns itself axially again and recloses the outlet opening 17.

Figure 6:
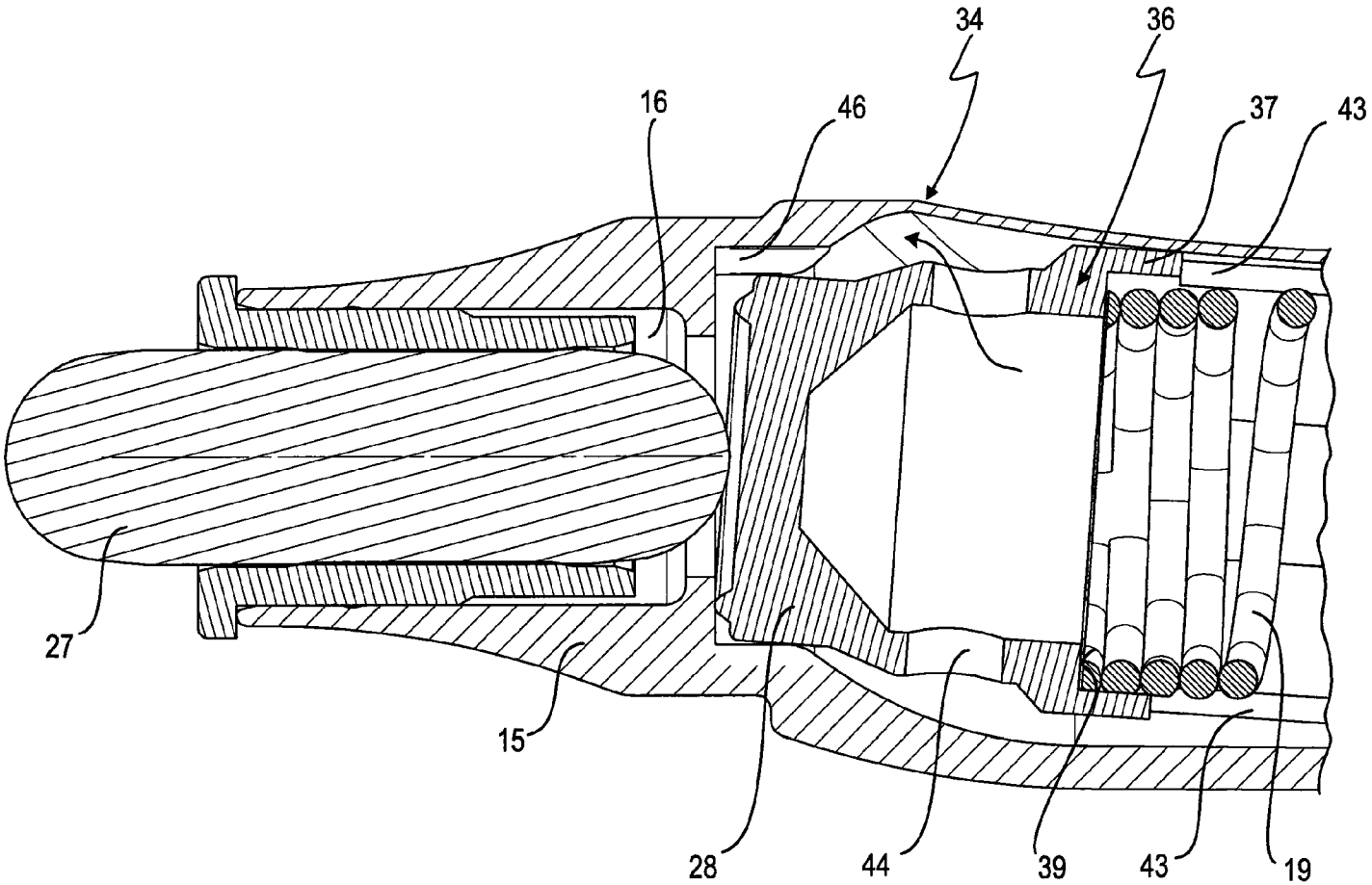
FIG. 6 shows an enlarged illustration of the tilted valve element according to FIG. 5.

FIG. 6 shows the situation in FIG. 5 on an enlarged scale as a detail. It can be seen here in particular that the valve element 18 has lateral through-openings 43 and 44 both at its rear end 36, i.e. in the bushing 37, and at its front end 34, through which through-openings 43 and 44 the medium can flow from inside to outside in the direction of an arrow 45, so that it can flow past the frusto-conical front end 34 of the valve element 18 and through the outlet opening 17 to the applicator 27.

A lateral recess 46 is provided on the inside of the tip 15 at the outlet opening 17 in that region which is opened by the tilting of the valve element 18, i.e. which faces the gripping region 21, said lateral recess 46 ensuring even better discharging of the medium into the channel 16; in this regard, see the description below relating to FIG. 9.

Figure 7:
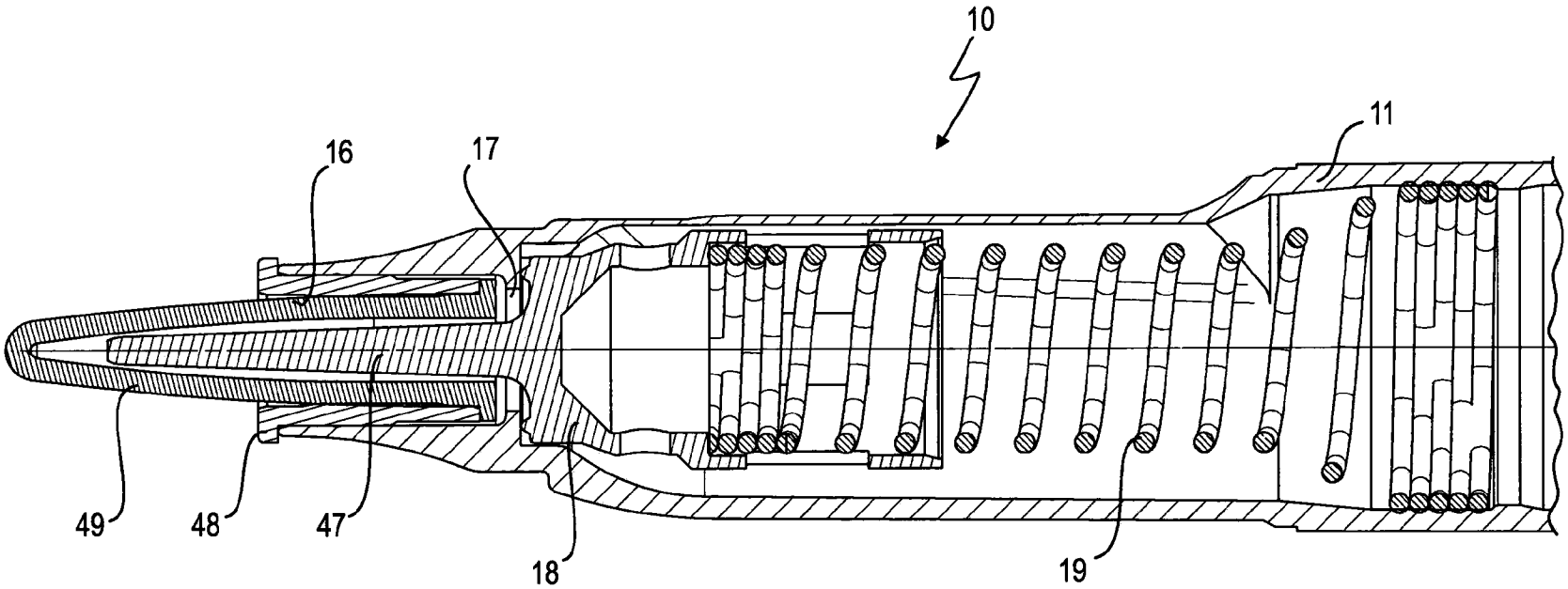
FIG. 7 shows a further embodiment of a device as in FIG. 4, but with a sensing tip integrally connected to the valve element.

FIG. 7 shows a further embodiment of the novel device 10, in the case of which a sensing tip 47 is connected integrally and centrally to the valve element 18, said sensing tip 47 extending through the opening 17 into the channel 16 and from there towards the outside, so that is protrudes forwards beyond the channel 16.

Also inserted into the channel 16 with the aid of a fitting bushing 48 is an applicator in the form of a brush 49, in which the sensing tip 47 then runs.

Otherwise, the construction of the device 10 from FIG. 7 is identical to the construction from FIGS. 1 to 6.

If the sensing tip 47 is now pressurized either in the axial direction or transversely, this leads to the valve element 18 being lifted axially off the outlet opening 17 or else being tilted as is shown in FIGS. 5 and 6.

In this way, it is possible to ensure the subsequent flow of medium out of the housing 11 to the brush 49 by applying appropriate pressure via the sensing tip 47.

Figure 8:
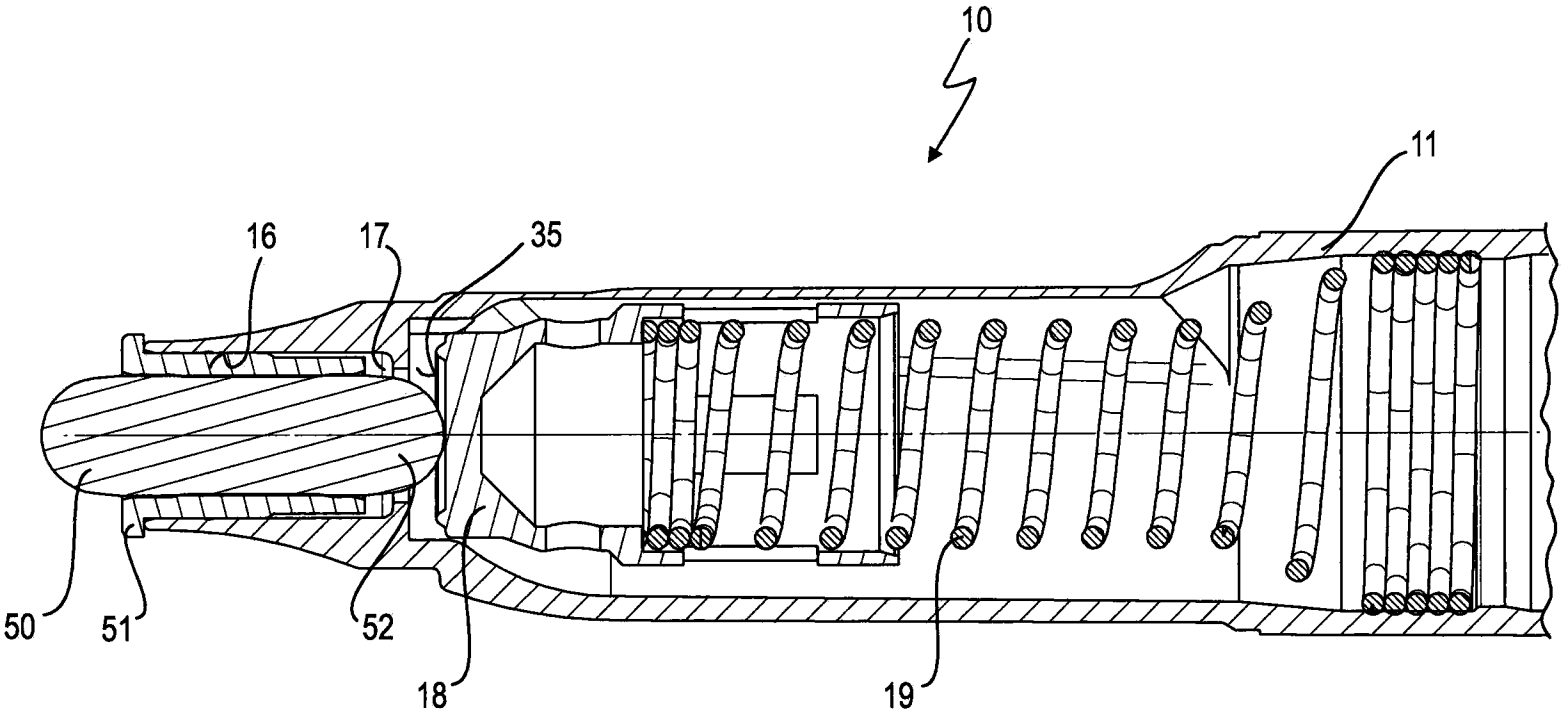
FIG. 8 shows a further embodiment of the device as in FIG. 5, but with axially displaced applicator in order to open the outlet opening.

FIG. 8 shows in a further embodiment that a wick 50 can be used as applicator, said wick 50 being inserted into the channel 16 via a fitting bushing 51.

The rear end 52 of the wick 50 protrudes through the outlet opening 17 and rests against the sealing element 35 of the valve element.

In FIG. 8, the wick 50 has been displaced so far to the right that it has lifted the valve element 18 off the outlet opening 17 counter to the force of the compression spring 19.

As in the case of the device from FIG. 7, it is thus possible to lift or tilt the valve element 18 off the opening 17 by pressing the device 10 hard against the surface to be treated.

FIG. 9 shows on the right-hand side a section through the tip 15 of the housing 11 in the longitudinal direction and on the left-hand side a section through the tip 15 of the housing 11 in the radial direction. It can be seen that the outlet opening 17 inside the tip 15 adjoins an annular portion 53 in which there is provided the lateral recess 46, through which medium passes to the outlet opening 17. Around the outlet opening 17 an annular shoulder 54 runs as the edge of the outlet opening 17, the sealing plate 35 provided at the front end 34 of the valve element 18 rising up in a freely tiltable manner on said annular shoulder 54 in the closed state.

FIG. 10 shows at the bottom a longitudinal sectional illustration and at the top a perspective illustration of the valve element 18 according to the embodiment from FIGS. 1 to 9. It can be seen that the valve element 18 is formed at its front end 34 as a frustoconical cone 57 and thus together with the rear bushing 37 as a whole as a rotationally symmetrical, hollow valve bushing 55, in which the lateral through-openings 43, 44 are arranged such that the valve bushing 55 can be inserted into the housing 11 in any desired circumferential orientation.

FIG. 11 shows, in a sectional illustration as in FIG. 10 at the bottom, a further embodiment of the valve element 18, provided at the front end 34 of which, in addition to the sealing element formed as a sealing surface 35, is a further sealing element in the form of a sealing ring 56 which ensures sealing with respect to the annular shoulder 54, which is shown in FIG. 9.

Figure 12:
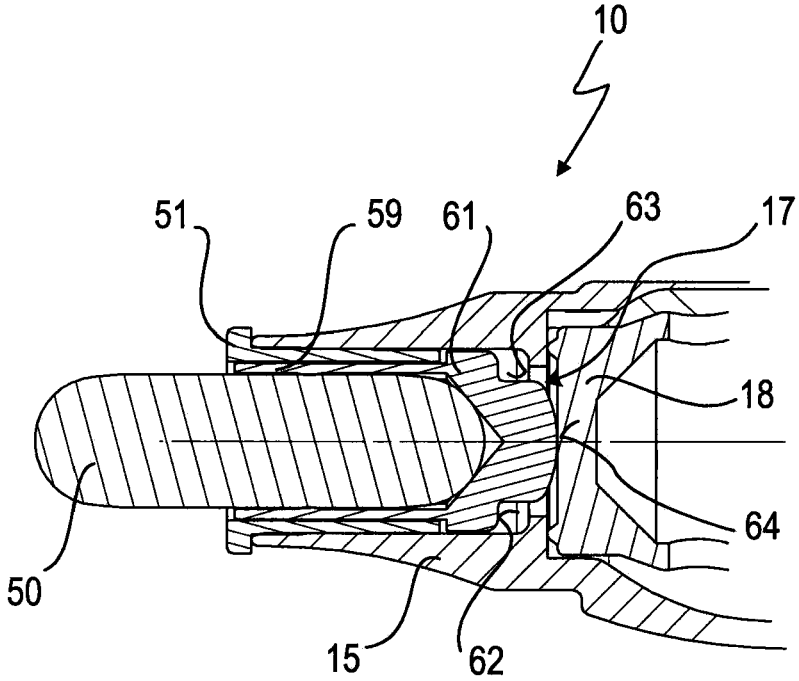
FIG. 12 shows, in an illustration as in FIG. 8, an embodiment in which the applicator is mounted in a longitudinally displaceable insert, with the outlet opening closed.
Figure 13:
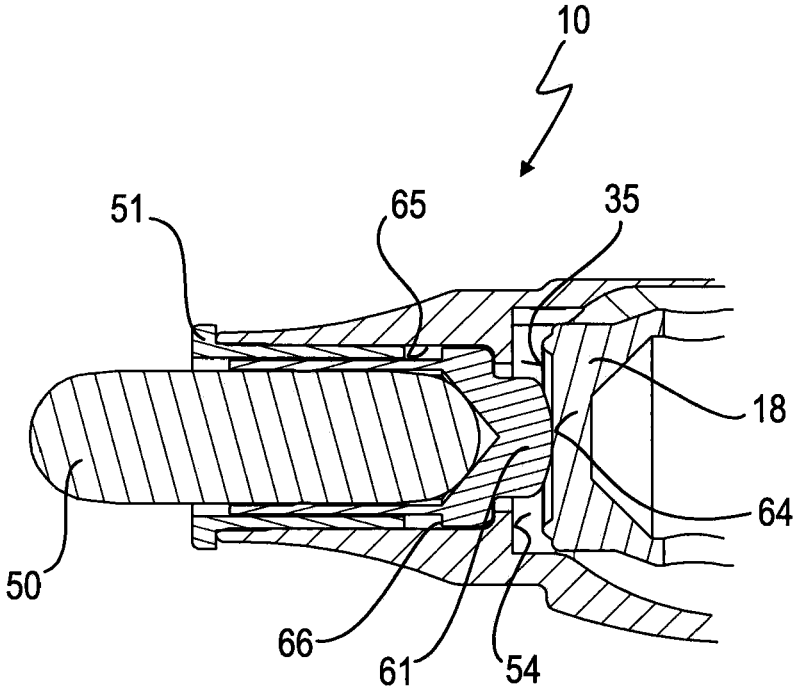
FIG. 13 shows an illustration as in FIG. 12, but with the outlet opening open.

FIGS. 12 and 13 show a modified embodiment in which, as in FIG. 8, a wick 50 is mounted in a longitudinally displaceable manner in a fitting bushing 51. However, the wick is in this case arranged firmly in a tubular insert 59 which can be displaced in the longitudinal direction to only a limited degree. The rear end 61 of the insert 59 protrudes through the outlet opening 17 towards the rear and interacts there with the valve element 18.

At the rear end 61, the insert 59 is provided with a shoulder 62 which is directed towards the rear and is assigned a forwardly directed shoulder 63 inside the tip 15.

In FIG. 12, the valve element closes the outlet opening in a manner already described, since it rests against the annular shoulder 54. If axial pressure is now applied to the wick 50 towards the right in FIG. 12, the insert 59 is displaced to the right into the fitting bushing 51 until the shoulders 62, 63 come into abutment against one another, as is shown in FIG. 13.

In this case, an end face 64 provided at the rear end 61 and directed towards the rear comes into abutment against the valve element 18 which is acted on by the compression spring 19, which is not shown in FIGS. 12 and 13.

As a result, the sealing element 35 on the valve element 18 is lifted off the annular shoulder 54 surrounding the outlet opening 17 and the outlet opening 17 is thus opened. The medium can now pass to the wick 50, with passages (not shown) in the rear end 61 allowing the medium to pass through.

If the axial pressure on the wick 50 is removed, the insert 59 is moved back into the position in FIG. 12 via the valve element 18 that is moved forwards under the pressure of the compression spring 19, with a rearwardly directed end side 65 of the fitting bushing 51 coming into abutment against a forwardly directed collar 66 at the rear end 61 of the insert 59 and preventing the insert 59 from falling out of the fitting bushing 51.

Therefore, what is claimed is:

1. A device for dosed dispensing of a fluid medium, comprising:

a generally tubular housing defining a longitudinal axis, said housing having a front end and including a storage chamber for accommodating the fluid medium, and a spring exerting a force, a tip being provided at said front end, in which tip there is provided an outlet opening for the fluid medium, a valve element arranged in said front end at said outlet opening in a tiltable manner, said valve element closing said outlet opening under the force of said spring, said valve element being arranged such that it tilts in a transverse direction relative to said longitudinal axis to at least partially open the outlet opening in response to radial pressure being applied from outside onto said front end of said housing, and wherein the housing comprises at its front end a generally flattened gripping region, which gripping region is made of a material that deforms elastically under radial pressure, and which gripping region is located at an axial location of said housing, said valve element further having a rear end that is arranged at approximately the same axial location as the gripping region, such that the deformation of said gripping region acts directly on said valve element causing the rear end of said valve element to tilt in the transverse direction.

2. The device of claim 1, wherein the valve element comprises a front end having a sealing element for closing the outlet opening, said rear end of said valve element being designed to accommodate a front end of said spring, said spring being an axially acting compression spring.

3. The device of claim 2, wherein said compression spring has a rear end, said compression spring extending axially between its front end and its rear end along the gripping region, said rear end of said compression spring being anchored inside said housing.

4. The device of claim 2, wherein the valve element comprises at its rear end a cylindrical bushing, in which the front end of the compression spring is arranged.

5. The device of claim 3, wherein the valve element comprises at its rear end a cylindrical bushing, in which the front end of the compression spring is arranged.

6. The device of claim 4, wherein at least one through-opening for the fluid medium is provided in or on the valve element.

7. The device of claim 2, wherein the outlet opening is enclosed by an annular shoulder, on which the sealing element rests.

8. The device of claim 2, wherein the sealing element comprises a sealing plate made of a flexible material.

9. The device of claim 2, wherein the sealing element comprises a sealing ring.

10. The device of claim 1, wherein a lateral recess is provided on an inside of the tip at the outlet opening, said lateral recess facing the gripping region of the housing.

11. The device of claim 1, wherein an applicator for dispensing said fluid and a channel for accommodating said applicator is provided in the tip of the housing, the outlet opening into said channel.

12. The device of claim 11, wherein a sensing tip is provided on the valve element, said sensing tip extending through the outlet opening and the channel and protruding beyond the channel towards the applicator.

13. The device of claim 11, wherein the applicator is arranged such that it is longitudinally displaceable in the channel and projects towards the valve element through the outlet opening such that it interacts with a front end of the valve element.

14. The device of claim 13, wherein a longitudinally displaceable insert is mounted in the channel which interacts by way of its rear end side with the front end of the valve element, the applicator being arranged in said insert.

15. A device for dosed dispensing of a fluid medium, comprising:

a generally tubular housing defining a longitudinal axis and having a front end and a gripping region arranged at said front end at a first axial position of said housing, said gripping region made of resilient material, said housing including a storage chamber for accommodating the fluid medium, and a spring exerting a force, a tip being provided at said front end of said housing, in which tip there is provided an outlet opening for the fluid medium, a valve element arranged in said front end at said outlet opening in a tiltable manner, said valve element closing said outlet opening under the force of said spring, said valve element having a rear end that is arranged at approximately the first axial position, such that the rear end of said valve element tilts in a transverse direction relative to said longitudinal axis in response to radial pressure being applied from outside onto said gripping region, causing said valve element to at least partially open the outlet opening, the valve element comprises a front end having a sealing element for closing the outlet opening, said rear end of said valve element accommodating a front end of said spring, said spring being an axially acting compression spring, said compression spring has a rear end, said compression spring extending between its front end and rear end along the gripping region.

16. A device for dosed dispensing of a fluid medium, comprising:

a generally tubular housing defining a longitudinal axis and having a front end and a gripping region arranged at said front end, said gripping region made of resilient material that deforms elastically under radial pressure, said housing including a storage chamber for accommodating the fluid medium, and a compression spring having a front end and a rear end anchored inside said housing and exerting a force, a tip being provided at said front end of said housing, in which tip there is provided an outlet opening for the fluid medium, a valve element arranged in said front end at said outlet opening in a tiltable manner, said valve element comprising a front end having a sealing element for closing said outlet opening under said force of said compression spring, said valve element having a rear end for receiving said front end of said compression spring, said compression spring extending axially between its front end and rear end along said gripping region, such that said valve element tilts in a transverse direction relative to said longitudinal axis to at least partially open the outlet opening in response to radial pressure being applied from outside onto said gripping region.

* * * * *